US007168126B2

(12) United States Patent
Biere

(10) Patent No.: US 7,168,126 B2
(45) Date of Patent: Jan. 30, 2007

(54) CENTRAL VACUUM CLEANER HAVING AN ENERGY RECOVERY VENTILATOR SYSTEM

(75) Inventor: Darin Biere, Webster City, IA (US)

(73) Assignee: White Consolidated Limited, Cleveland, OH (US)

( * ) Notice: Subject to any disclaimer, the term of this patent is extended or adjusted under 35 U.S.C. 154(b) by 609 days.

(21) Appl. No.: 10/726,032

(22) Filed: Dec. 1, 2003

(65) Prior Publication Data

US 2005/0115013 A1 Jun. 2, 2005

(51) Int. Cl.
*A47I 5/38* (2006.01)

(52) U.S. Cl. ..... 15/314; 15/301; 15/327.1; 15/347; 55/DIG. 8

(58) Field of Classification Search ..... 15/301, 15/314, 315, 327.1, 327.6, 347, 352; 55/DIG. 8; 454/241, 243, 244, 251; *A47L 5/38*
See application file for complete search history.

(56) References Cited

U.S. PATENT DOCUMENTS 1,087,228 A * 2/1914 Ferguson ..... 15/314
1,162,151 A * 11/1915 Fitts et al. ..... 15/314
1,228,931 A * 6/1917 Kirk ..... 15/314
2,431,726 A * 12/1947 Bechtler ..... 15/301
2,725,113 A * 11/1955 Fagyas ..... 15/314
2,979,755 A * 4/1961 McCaskill ..... 15/314
4,967,645 A 11/1990 Mattson ..... 454/296
RE33,810 E 2/1992 Strieter ..... 134/99.1
5,257,736 A 11/1993 Roy ..... 236/49.3
5,924,163 A 7/1999 Burns, Jr. ..... 15/314
6,218,798 B1 4/2001 Price et al. ..... 318/445

* cited by examiner

*Primary Examiner*—Theresa T. Snider
(74) *Attorney, Agent, or Firm*—Pearne & Gordon LLP

(57) ABSTRACT

A central vacuum assembly including a vacuum cleaning apparatus, a ventilation apparatus, a heat exchanger for transferring heat energy between air in the vacuum cleaning apparatus and air in the ventilation apparatus. Optionally, a fan for circulating air within the vacuum cleaning apparatus and/or the ventilation apparatus operates in a low speed mode for ventilation and a high speed mode for vacuuming.

19 Claims, 1 Drawing Sheet

CENTRAL VACUUM CLEANER HAVING AN ENERGY RECOVERY VENTILATOR SYSTEM

BACKGROUND OF THE INVENTION

The present invention relates to a central vacuum cleaning unit, and more particularly to a central vacuum cleaning unit including an energy recovery ventilator system Modern residential and commercial buildings, especially single family homes, are built to resist external weather conditions. Construction techniques and materials are chosen to seal buildings so that air exchange between the interior and the exterior of the building is minimized to reduce heating and cooling costs. As a convenience, many buildings are also provided with a central vacuum system used to clean floors and other surfaces in the building. Briefly, a central vacuum system includes a motor driven vacuum unit, vacuum ports located throughout the structure, duct work placed in the walls of the building to connect the vacuum unit to the vacuum ports and a user manipulable cleaning attachment which mates with the vacuum ports. The vacuum source is typically placed in a somewhat remote location, such as a garage. Electrical cabling can be installed with the duct work to provide an electrical connection between the vacuum unit and the cleaning attachment. Such an electrical connection is used to switch the vacuum unit on or off. Other electrical connections can be used to power a rotary brush mounted on the cleaning attachment.

As the central vacuum system operates, air is exhausted from the building. This depletes the air inside the building, especially in buildings that are well sealed to prevent air transfer between the interior and exterior of the building. Various ways to introduce air into buildings are known in the art of building ventilation. As an example, U.S. Pat. No. 2,725,113, incorporated herein by reference, discloses a central vacuum system where both a fresh air supply opening and a vacuum source opening are provided on panels throughout the building. When the central vacuum is operating, a common motor supplies fresh air and suction to the panel being used by an operator. However, this example system does not balance the air flow of exhausted air and fresh air.

Air exchangers, otherwise referred to as air to air heat exchangers or heat recovery ventilators, for providing a balanced flow of air into and out of a building are also known. For example, U.S. Pat. No. 5,257,736, incorporated herein by reference, discloses an air exchanger having a pressure sensor. If the sensor detects a negative pressure in the building, the air exchanger stops pumping air out of the building to balance the air pressure. Air exchangers typically provide a range of functions such as reducing air contamination, heating or cooling air entering the building, and/or humidifying or dehumidifying air entering the building. Accordingly, the air exchanger is usually connected to the rest of the building's ventilation system and operates independently of other appliances. Operation of the vacuum is determined by sensing the resulting pressure differentiation rather than by an electrical connection.

U.S. Pat. No. 6,218,798 B1 to Price et al., incorporated herein by reference, is discloses an interface for linking a central vacuum unit with an air exchanger. A motor is provided to the central vacuum to create sufficient negative pressure for vacuuming a household surface. Similarly, a motor is provided to the air exchanger to supply air to an interior environment from an exterior environment while the central vacuum is being operated. Outside air drawn in through a fresh air inlet of the air exchanger is supplied to an interior environment when the vacuum is activated. Fresh air being vented to the interior environment and the stale air being exhausted externally is filtered through filter cartridges to remove debris from the air streams. The interface links the central vacuum unit with the air exchanger to provide synchronized, cooperative operation.

However, the central vacuum disclosed in U.S. Pat. No. 6,218,798 B1 does not operate in cooperation with the air exchanger when vacuuming is not required. Such operation would be noisy and energy inefficient since central vacuum units typically operate at a high air flow rate in order to produce a sufficient vacuum. Further, the system of U.S. Pat. No. 6,218,798 B1 is costly since the central vacuum unit, the air exchanger and the interface must each be purchased separately.

SUMMARY OF THE INVENTION

The present invention provides a central vacuum unit comprising: a housing; a stale air inlet; a stale air outlet; a fresh air inlet; a fresh air outlet; a vacuum fan for drawing stale air through the stale air inlet and out through the stale air outlet; a fresh air fan for drawing fresh air through the fresh air inlet and out through the fresh air outlet; a waste collection chamber for collecting debris carried by the stale air entering the stale air inlet; and a heat exchanger for transferring heat energy between the stale air and the fresh air.

DETAILED DESCRIPTION OF THE INVENTION

Figure 1:
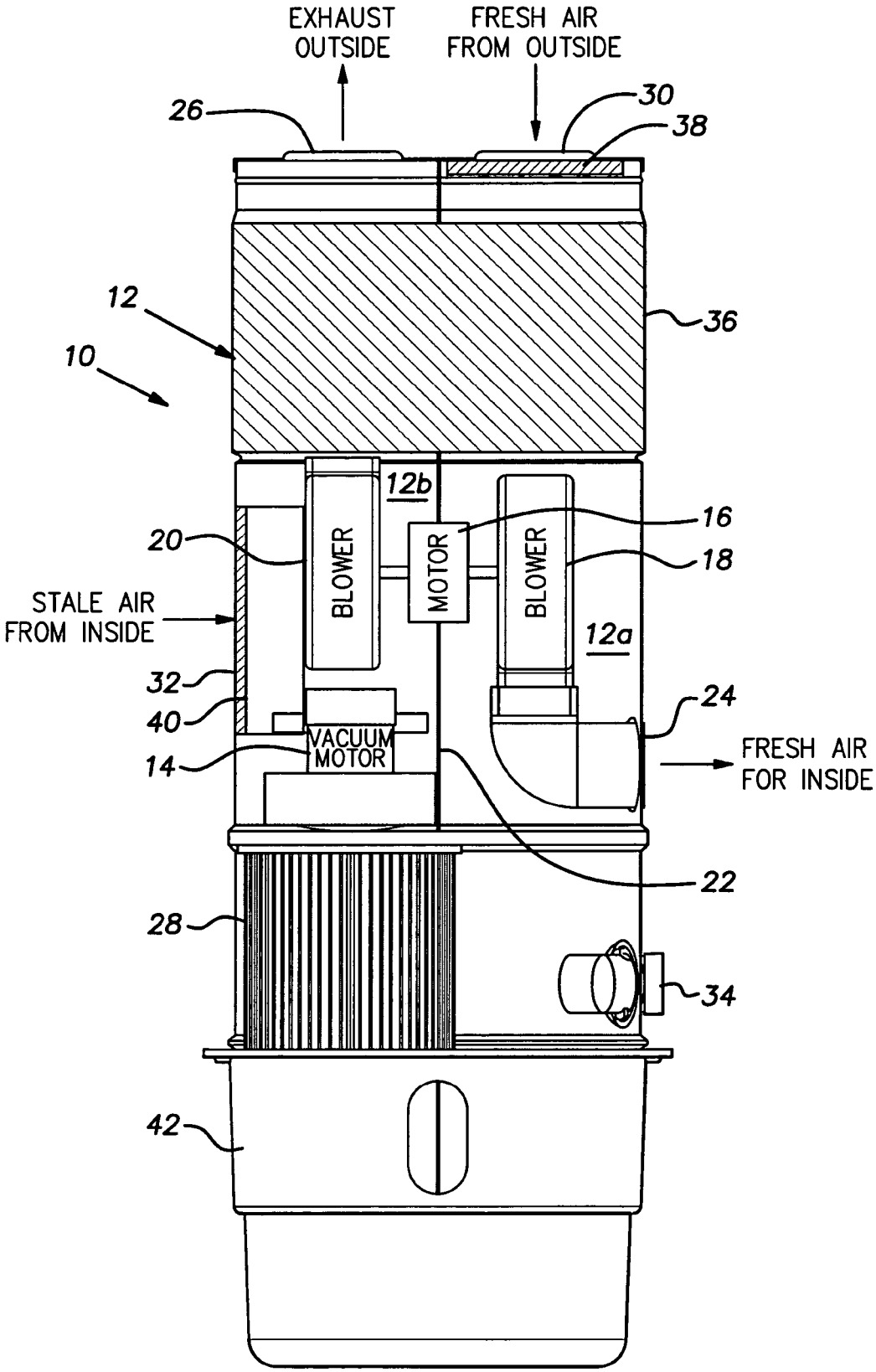
FIG. 1 is a partially schematic view of a central vacuum cleaner unit according to the present invention.

As shown in FIG. 1, the present invention relates to a central vacuum cleaner unit 10 having an energy recovery ventilator system The central vacuum cleaner unit 10 comprises a housing 12 enclosing a plurality of motors, a vacuum motor 14, and a ventilation motor 16 to circulate air between an interior building environment and an exterior environment. A divider wall 22 separates the housing 12 into a fresh air chamber 12*a* and a stale air chamber 12*b*.

The interior building environment includes a network of air return duct terminating at wall vents at various locations within the building and a fresh air supply duct connected to air supply registers located throughout the building. The exterior environment includes a vent conduit terminating at an exhaust vent on the outside of the building and a fresh air supply conduit in communication with an inlet vent on the outside of the building.

Outside air is drawn from the exterior environment by a clean air fan 18 of the ventilation motor 16 through the fresh air supply conduit into a fresh air inlet 30. This outside air exchanges heat energy with stale air being withdrawn from the interior environment by a stale air fan 20 of the ventilation motor 16 through the air return duct into a stale air inlet 32. Also, when the vacuum motor 14 is in operation it powers a vacuum fan by which stale dirt laden air is drawn through a vacuum hose network located throughout the building and into a second stale air inlet or vacuum inlet 34. The vacuum hose network include vacuum ports to which cleaning implements can be connected.

The exchange of heat energy is accomplished via a heat exchanger in the form of a rotary air-to-air heat exchanger, or heat wheel 36. The heat wheel 36 is in communication with both the fresh air chamber 12*a* and the stale air chamber 12*b*.

Fresh air having been filtered through a fresh air filter 38 is vented to the interior environment from a fresh air outlet 24 through the fresh air supply duct. Stale air having been filtered by a stale air filter 40 and dirt laden air having been filtered by the vacuum filter 28 is exhausted externally through an exhaust outlet 26 and through the vent conduit to the exterior environment. Large debris in the dirt laden air is collected in a removable waste bucket 42.

Alternatively, the clean air fan and the stale air fan could be driven by separate motors. Further, another type of heat exchanger could be used in place of the heat wheel 36, including a shell-and-tube type heat exchanger and a plate-type heat exchanger.

As a further alternative, the stale air fan could be powered by the vacuum motor and also be used to generate a vacuum at the vacuum inlet 24. Further, in this arrangement, in order to provide sufficient suction, a diverter valve (not shown) may be provided which automatically closes the stale air inlet 32 when the unit is in vacuuming mode.

In a normal or a ventilation mode, the ventilation motor 16 is operated at a low speed to draw air from within the interior environment to be replaced with fresh air from the external environment. All air passing through the intakes 30, 32, 34 is filtered by the air filters 28, 38, 40 to remove debris and either supplied with, or stripped of heat energy by air from the opposite environment. With the ventilator motor 16 operating in this mode, a minimal amount of noise is produced.

In order to use the unit 10 as a central vacuum cleaner, for vacuuming floors and the like, the unit is switched to a vacuuming mode. In the vacuuming mode, the vacuum motor 14 is energized to create negative pressure at the vacuum inlet 34 to remove debris from the interior environment. Optionally, in vacuuming mode the ventilation motor 16 is operated at a high speed for better efficiency since the noise level may be less of an issue at this time. Just as in the ventilation mode, the air being removed from the interior environment exchanges heat and is replaced with fresh air from the exterior environment, either from the stale air inlet 32 are from the vacuum inlet 34, the air having been filtered of debris. Upon completing the vacuuming, the vacuum motor 14 is stopped, and if operating at a higher speed, the ventilation motor 16 is returned to its low speed ventilation mode.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

The invention claimed is:

1. A central vacuum unit comprising:

a housing having:

a vacuum inlet;

a stale air outlet;

a fresh air inlet;

a fresh air outlet;

a vacuum fan for drawing dirt laden stale air through the vacuum inlet and out through the stale air outlet;

a fresh air fan for drawing fresh air through the fresh air inlet and out through the fresh air outlet;

a waste collection chamber for collecting debris carried by the stale air entering the vacuum inlet; and a heat exchanger for transferring heat energy between the stale air and the fresh air.

2. The central vacuum unit of claim 1 wherein the vacuum inlet is adapted to be connected to a cleaning implement.

3. The central vacuum unit of claim 1 wherein the fresh air fan has a low speed mode and a high speed mode.

4. The central vacuum unit of claim 1 further comprising an air filter in communication with at least one of the vacuum inlet and the fresh air inlet.

5. The central vacuum unit of claim 1 further comprising a stale air inlet, and a stale air fan wherein the stale air fan draws stale air through the stale air inlet.

6. The central vacuum unit of claim 1 further comprising a dividing wall within the housing separating the stale air from the fresh air.

7. The central vacuum unit of claim 1, wherein the heat exchanger is a rotary air-to-air heat exchanger.

8. The central vacuum unit of claims 1 further comprising a stale air inlet, wherein the vacuum fan functions also as a stale air fan and draws air through the stale air inlet and out through the stale air outlet.

9. A central vacuum assembly comprising:

a vacuum cleaning apparatus;

a ventilation apparatus;

a heat exchanger for transferring heat energy between air in the vacuum cleaning apparatus and air in the ventilation apparatus; and a fan for circulating air within at least one of the vacuum cleaning apparatus and the ventilation apparatus.

10. The central vacuum unit of claim 9, wherein the heat exchanger is a rotary air-to-air heat exchanger.

11. The central vacuum unit of claim 9 further comprising an air filter in communication with the air.

12. The central vacuum unit of claim 9 wherein the fan operates at a first speed in a ventilation mode and the fan operates at a second speed in a vacuum mode, the second speed being higher than the first speed.

13. A central vacuum unit comprising:

a housing;

a dividing wall within the housing defining a stale air chamber and a fresh air chamber;

a stale air inlet in the housing in communication with the stale air chamber for connection to an interior environment;

a vacuum inlet in the housing in communication with the stale air chamber for attachment to a cleaning device;

a stale air outlet in communication with the stale air chamber for connection to an exterior environment;

an exhaust filter within the stale air chamber separating the stale air outlet from the stale air inlet;

a vacuum filter within the housing for removing particulate matter from air drawn in through the vacuum inlet;

a stale air fan within the stale air chamber for drawing stale air through the stale air inlet, through the exhaust filter, and out through the stale air outlet;

a vacuum fan for drawing dirt laden air in through the vacuum inlet and through the vacuum filter;

a fresh air inlet in communication with the fresh air chamber for connection to the exterior environment;

a fresh air outlet in communication with the fresh air chamber for connection to the interior environment;

a fresh air filter within the fresh air chamber separating the fresh air outlet from the fresh air inlet;

a fresh air fan within the fresh air chamber for drawing fresh air through the fresh air inlet, through the fresh air filter, and out through the fresh air outlet;

a waste collection chamber for collecting debris carried by the dirt laden air entering the vacuum inlet; and a rotary air-to-air heat exchanger extending into the stale air chamber and the fresh air chamber for transferring heat energy between the stale air and the fresh air.

14. The central vacuum unit of claim 13 wherein the stale air fan and fresh air fan operate at a first speed in a ventilation mode and the stale air fan and fresh air fan operate at a second speed in a vacuum mode, the second speed being higher than the first speed, and wherein in the vacuum mode the vacuum fan operates to create a vacuum to draw dirt laden air into the vacuum inlet.

15. The central vacuum unit of claim 13 further comprising:

a ventilation motor for powering the stale air fan and the fresh air fan; and a vacuum motor for powering the vacuum fan.

16. The central vacuum unit of claim 13 further comprising:

a ventilation motor for powering the fresh air fan; and a vacuum motor for powering the vacuum fan and the stale air fan.

17. A central vacuum cleaning system comprising:

a central vacuum unit comprising a vacuum cleaning apparatus, a ventilation apparatus, a heat exchanger for transferring heat energy between air in the vacuum cleaning apparatus and air in the ventilation apparatus, and a fan for circulating air within the central vacuum unit;

a vacuum duct in fluid communication with a vacuum inlet of the vacuum cleaning apparatus; and a plurality of vacuum ports in fluid communication with the vacuum duct, the plurality of vacuum ports being connectable to cleaning implements.

18. The system of claim 17, wherein the fan operates at a first speed in a ventilation mode and the fan operates at a second speed in a vacuum mode, the second speed being higher than the first speed.

19. The system of claim 17, wherein the ventilation apparatus is in fluid communication with the vacuum cleaning apparatus.

* * * * *